US012041976B2

(12) United States Patent
Reid et al.

(10) Patent No.: US 12,041,976 B2
(45) Date of Patent: Jul. 23, 2024

(54) BRASSIERE FOR SECURING REMOVABLE POUCH

(71) Applicants: Tanthia Fanette Reid, Suwanee, GA (US); Tyrone Andrea Reid, Suwanee, GA (US)

(72) Inventors: Tanthia Fanette Reid, Suwanee, GA (US); Tyrone Andrea Reid, Suwanee, GA (US)

(73) Assignee: Tanthia Fanette Reid, Suwanee, GA (US)

( * ) Notice: Subject to any disclaimer, the term of this patent is extended or adjusted under 35 U.S.C. 154(b) by 80 days.

(21) Appl. No.: 17/739,657

(22) Filed: May 9, 2022

(65) Prior Publication Data

US 2022/0354190 A1 Nov. 10, 2022

Related U.S. Application Data

(60) Provisional application No. 63/186,567, filed on May 10, 2021.

(51) Int. Cl.

| | |
|---|---|
| ***A41C 3/00*** | (2006.01) |
| ***A45C 11/22*** | (2006.01) |
| *A45C 1/02* | (2006.01) |

(52) U.S. Cl.

CPC ..... *A41C 3/0035* (2013.01); *A41C 3/005* (2013.01); *A45C 11/22* (2013.01); *A45C 2001/022* (2013.01)

(58) Field of Classification Search

CPC ..... A41C 3/0035; A44C 11/22
USPC ..... 450/89
See application file for complete search history.

(56) References Cited

U.S. PATENT DOCUMENTS

| | | | | |
|---|---|---|---|---|
| 5,573,441 | A | 11/1996 | Smith | |
| 6,318,613 | B1 | 11/2001 | Underhill | |
| 8,597,072 | B1 * | 12/2013 | Lucas | A41C 3/0035 2/247 |
| 9,557,139 | B1 * | 1/2017 | Miner | A44B 18/0073 |
| 9,826,784 | B1 * | 11/2017 | Cutrona | B26B 29/025 |
| 10,798,977 | B1 * | 10/2020 | Ransom | A41C 3/0035 |
| 11,785,993 | B1 * | 10/2023 | Zuniga | A41C 3/0028 450/82 |
| 2007/0270078 | A1 | 11/2007 | Henry | |
| 2009/0209173 | A1 * | 8/2009 | Arledge | A41C 3/0057 450/86 |
| 2011/0244758 | A1 | 10/2011 | Boatright et al. | |
| 2012/0064799 | A1 | 3/2012 | Rivers | |
| 2012/0276812 | A1 * | 11/2012 | Wollowick | A41C 3/0035 2/247 |
| 2014/0106646 | A1 | 4/2014 | Delgado | |
| 2018/0132541 | A1 | 5/2018 | Wittstadt et al. | |

* cited by examiner

*Primary Examiner* — Timothy K Trieu
(74) *Attorney, Agent, or Firm* — Fish & Richardson P.C.

(57) ABSTRACT

Brassieres and methods for forming brassieres are described. In one aspect, a brassiere includes a left cup, a right cup, and a pouch receiving area formed on an inside of the left cup or the right cup. The pouch receiving area includes a fastener that secures a removable pouch on an inside of at least one of the left cup or the right up.

16 Claims, 7 Drawing Sheets

BRASSIERE FOR SECURING REMOVABLE POUCH

CROSS-REFERENCE TO RELATED APPLICATIONS

This application claims the benefit of U.S. Provisional Application 63/186,567, filed on May 10, 2021, which is incorporated herein by reference in its entirety.

BACKGROUND

This specification relates to brassieres. Brassieres are worn on a daily basis and vary based on the activities of the wearer. Brassieres provide support for, and coverage of, the chest region of the wearer.

SUMMARY

This specification describes a brassiere. This specification further describes a method of forming a brassiere.

In general, one aspect of the subject matter described in this specification can be embodied in a brassiere that has a left cup, a right cup, and a pouch receiving area formed on the inside of the left cup or right cup. The pouch receiving area includes a fastener that secures a removable pouch on the inside of at least one of the left cup or the right cup.

These and other aspects can each optionally include one or more of the following features.

The pouch receiving area can include a pocket formed on the inside of at least one of the left cup or the right cup. In some implementations, the pocket is configured to receive an insert.

The fastener can include at least one snap socket configured to receive a snap stud.

The fastener can include at least one button hole configured to receive a button.

The brassiere can include a receiving area flap that covers the fastener when the removable pouch is not located in the pouch receiving area.

The receiving area flap can include a fastening assembly to secure the receiving area flap to a removable pouch.

The left cup or the right cup can include pouch padding that reduces an outward visual appearance of the removable pouch when located in the pouch receiving area.

The brassiere can include a removable pouch, and the removable pouch contains a top edge, bottom edge, a pair of side edges, and at least two pockets. The pockets can each have a bottom edge, a top edge, and a pair of side edges.

The removable pouch can include a pouch flap extending from the top edge of the removable pouch for folding over a top edge of at least one pocket.

The pouch flap can include a fastening assembly to secure the pouch flap to the removable pouch.

The removable pouch can include a pocket configured to hold a credit card.

The removable pouch can include a snap stud for securing the removable pouch to the pouch receiving area.

The bottom edge of the removable pouch may not be coextensive with the bottom edge of at least one pocket.

At least one of the pockets can include a waterproof inner lining having an inside wall, an outside wall, a bottom edge, a top edge, and a pair of side edges. The waterproof inner lining can include at least one seal affixed to the inside wall running perpendicular to the side edges.

The waterproof inner lining can include a second seal affixed to the inside wall extending between the side edges.

At least one seal in the waterproof inner lining can include a first side formed from a plastic resin material that grippingly engages a second side formed from the plastic resin material when pressed together.

The waterproof inner lining can be removable.

At least one seal in the waterproof inner lining can be located more proximate to the top edge of the waterproof inner lining than at least another seal that is located at a given distance between the top edge and the bottom edge of the waterproof inner lining.

These general and specific aspects may be implemented in a brassiere, a method of forming a brassiere, or any combination of a brassiere and method of forming a brassiere.

In general, one innovative aspect of the subject matter described in this specification can be embodied in a method of forming a brassiere including forming a left cup of the brassiere, forming a right cup of the brassiere, and forming a pouch receiving area on the inside of the left cup or the right cup. The pouch receiving area includes a fastener that secures a removable pouch on the inside of at least one of the left cup or the right cup.

Some implementations include one or more of the following features.

Methods can include attaching one or more snap sockets configured to receive snap studs in the fastener.

Methods can include creating one or more button holes configured to receive buttons in the fastener.

Methods can include forming a pocket configured to receive an insert in the fastener.

Particular embodiments of the subject matter described in this specification can be implemented to realize one or more of the following advantages: utilizing a brassiere to carry multiple personal items at one time in a secure and comfortable manner or in a manner not noticeable to an onlooker.

The details of one or more embodiments of the invention are set forth in the accompanying drawings and the description below. Other features, objects and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1A:
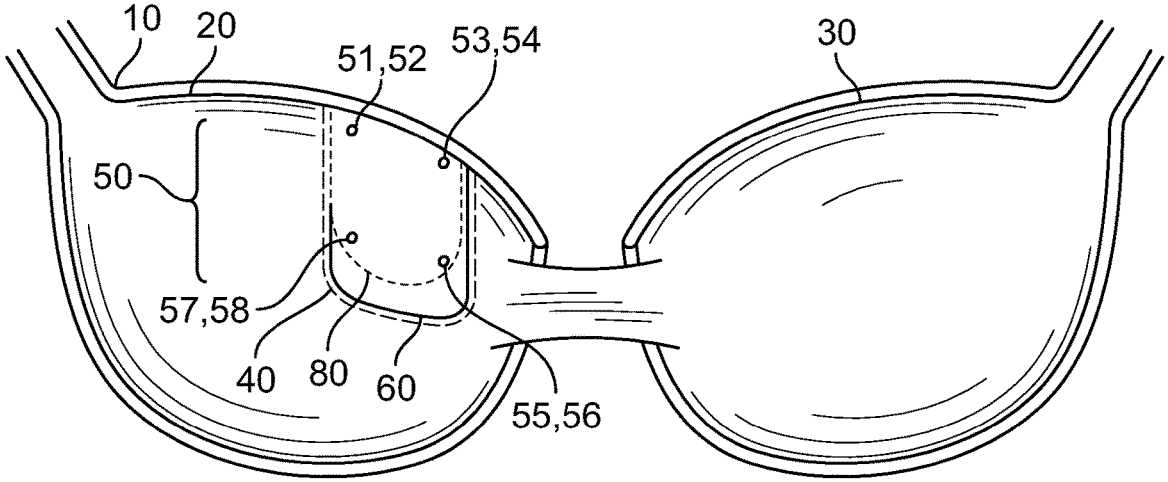
FIG. 1A is a drawing of the inside of an example brassiere.

This document describes brassieres, which includes brassieres of bathing suits, for securing a removable pouch to carry personal items while performing daily tasks. Persons wearing brassieres typically carry their personal items in a purse or bag when performing daily tasks. However, by placing personal items in a purse or bag, a person is more susceptible to having those personal items lost or stolen and may not be able to move quickly where speed is vital to avoid losing those items. Some people may use their brassieres to hold small items, but a conventional brassiere is not able to carry multiple personal items at one time in a secure and comfortable manner or in a manner that is not noticeable to an onlooker.

The brassieres described here achieve the goals of providing sufficient space for carrying multiple personal items, avoiding undue irritation in the skin, and maintaining the appearance of a normal brassiere while performing daily tasks. The brassieres described here also achieve the versatility desired by persons seeking to have the option of attaching or detaching a removable pouch for carrying multiple personal items in a brassiere for daily or occasional wear. Some implementations of the brassieres described here further allow a person to carry personal items in a waterproof or water-resistant compartment that avoids damage to personal items from exposure to moisture.

Many aspects of the subject matter described here can be better understood with the references made to the drawings described in more detail below. The components in the drawings illustrate examples and are not necessarily drawn to scale.

FIG. 1A illustrates the inside of a brassiere 10 that contains a left cup 20 and right cup 30. The inside of the left cup 20 contains a pouch receiving area 40 that includes a fastener 50 for securing a removable pouch 60 on the inside of the left cup 20. While the placement of the pouch receiving area 40 as shown in FIG. 1A may be better suited for right-handed persons, the pouch receiving area 40 for securing the removable pouch 60 can alternatively be formed inside of the right cup 30 to permit a left-handed person to more easily retrieve items carried in the removable pouch. In some implementations, a first pouch receiving area can be formed on the inside of the left cup of the brassiere and second pouch receiving area can be formed on the inside of the right cup of the brassiere, so as to provide the wearer the option of attaching a removable pouch to either the left cup, right cup, or both cups of the brassiere at one time.

The fastener can include at least one snap socket configured to receive a snap stud. Referring to FIG. 1A, the fastener 50 can include a set of four snap sockets (51, 53, 55, 57) placed around the pouch receiving area 40 to secure the removable pouch 60. Alternatively, the fastener 50 attached to the brassiere 10 can be made of one or more snap sockets configured to receive snap studs, snap studs configured to receive snap sockets, button holes configured to receive buttons, buttons configured to receive button holes, hook-type fasteners, loop-type fasteners, parts of a zipper, or other fasteners typically used in apparel for attaching or detaching cloth pieces. For example, the fastener can be a pocket formed (e.g., sewn on) the inside of a cup with an opening configured to receive an insert attached to the removable pouch 60 for securing the removable pouch 60 to the brassiere 10 in the pouch receiving area 40.

Referring to FIG. 1A, the removable pouch 60 can be approximately rectangular in shape and contoured along its top edge to fit the shape of the brassiere 10, so that the removable pouch 60 sits closer to the center of the brassiere when attached. The removable pouch may also be of other approximate shapes and sizes for holding small personal items, such as rectangular, oblong, circular, semicircular, trapezoidal, pentagonal, hexagonal, etc. For example, the removable pouch may vary in shape to conform to the shape of the brassiere 10 in the pouch receiving area 40. In some implementations, for example, the removable pouch 60 can be approximately 3% in. long and 2 in. wide.

FIG. 1A shows that the fastener 50 can contain four snap sockets (51, 53, 55, 57) placed around the pouch receiving area 40, although more or less snap sockets may be used in alternative embodiments. The removable pouch 60 can contain a corresponding snap stud (52, 54, 56, 58) for each of the snap sockets (51, 53, 55, 57) of fastener 50. The fastener 50 can be secured to the removable pouch 60 by inserting the corresponding snap studs (52, 54, 56, 58) attached to the removable pouch 60 into each of the snap sockets (51, 53, 55, 57) of fastener 50 attached to the brassiere, thereby forming four snap buttons. Alternatively, the snap studs can be attached to the brassiere and the snap sockets can be attached to the removable pouch.

FIG. 1A shows a receiving area flap 80 can be attached to the brassiere 10. The receiving area flap covers the fastener 50 when the removable pouch 60 is not in the pouch receiving area 40. The receiving area flap 80 may be sewn into the brassiere at the top seam of the left cup, right cup, or both cups, depending on where the corresponding pouch receiving area 40 is located. Although the receiving area flap can be made of one continuous piece of material as shown in FIG. 1A, the receiving area flap can also be made of multiple pieces of material for covering the fastener, so as to create a barrier between the fastener and skin when the brassiere is worn. The receiving area flap can be made of the same material as the brassiere, or alternatively of other material for creating a barrier between the fastener 50 and the skin. The receiving area flap can be made of any materials that avoid irritation or discomfort to the skin. Suitable materials include fabrics made from natural fibers, synthetic fibers, or combinations and blends thereof.

Figure 1B:
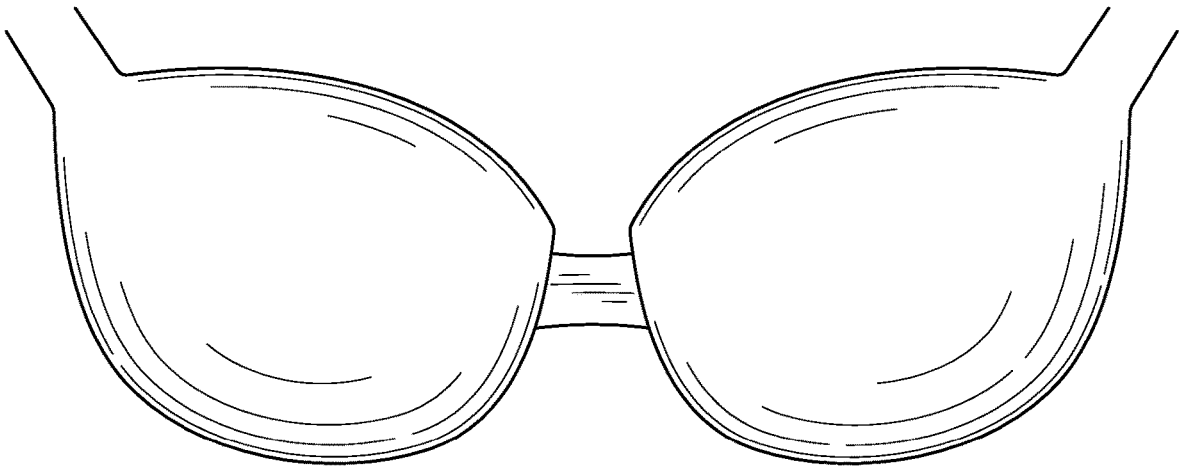
FIG. 1B is a drawing of the outside view of an example brassiere.

Referring to FIG. 1B, the brassiere 10 can maintain the normal appearance of a conventional brassiere from the outside of the brassiere. In some implementations, additional pouch padding can be added to the left or right cup to reduce the outward appearance of the removable pouch when attached to the brassiere. For example, the additional pouch padding can be inserted at a location of a cup corresponding to the location of the pouch receiving area. In some implementations, the pouch padding can be inserted directly into the cup of a brassiere. The pouch padding may also be added to the outside or inside of a cup of a brassiere to conceal the removable pouch. The pouch padding may be removable from the brassiere or permanently inserted to the brassiere.

Figure 2:
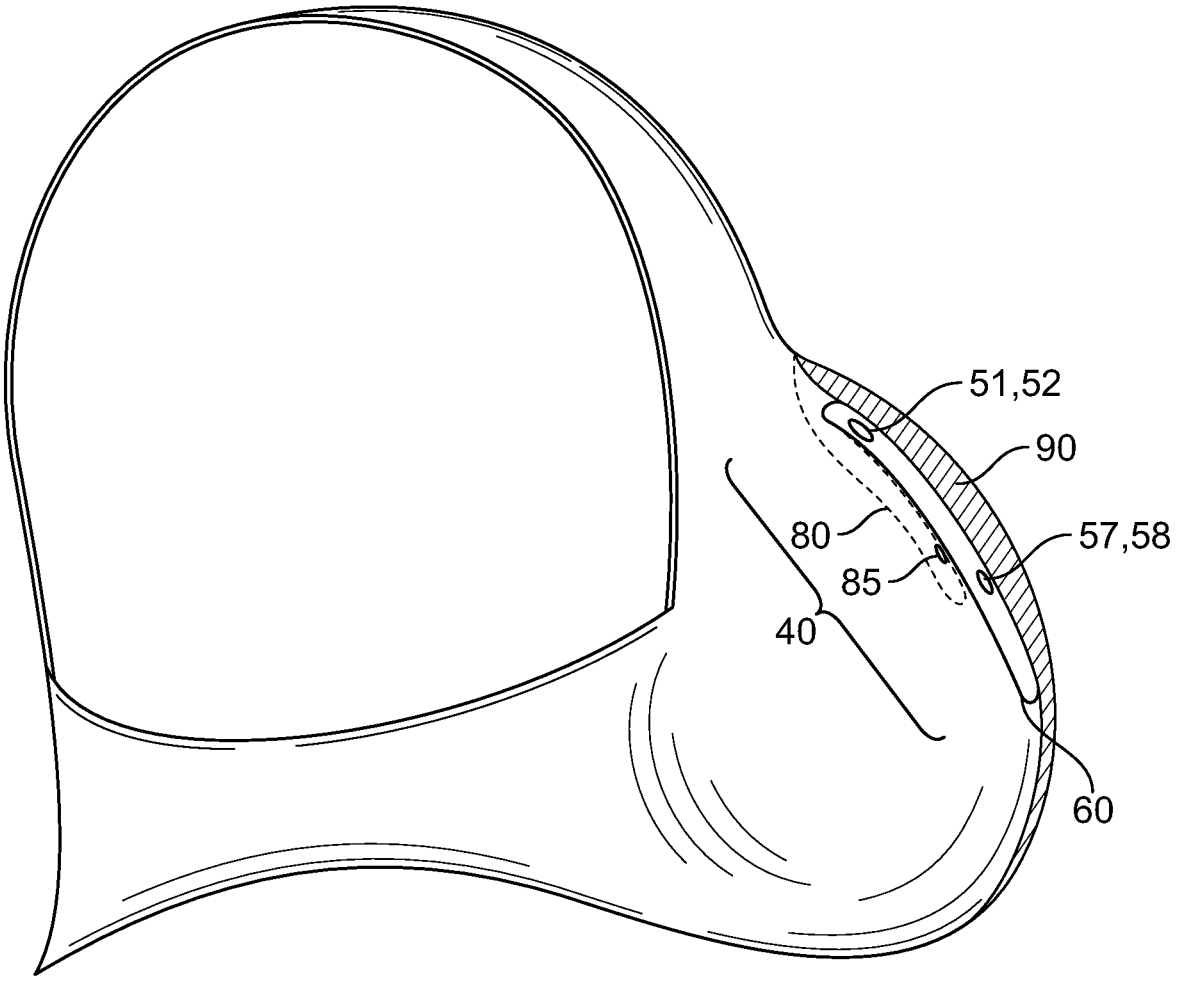
FIG. 2 is a drawing of the cross-section of the side view of an example brassiere.

FIG. 2 shows a side view of an example brassiere, including the receiving area flap 80, the snap sockets (51, 57) of fastener 50, snap studs (52, 58) attached to the removable pouch 60, removable pouch 60, and the pouch padding 90. FIG. 2 shows that the pouch padding 90 can be inserted into the cup to maintain the shape and fit of the cup of the brassiere. The pouch padding 90 can also reduce the outward appearance of the contours of the fastener 50 and, when attached, the removable pouch 60 and snap studs (52, 58).

FIG. 2 shows the placement of the pouch padding 90 of the brassiere can be aligned with the location of the pouch receiving area 40. Depending on the size and style of the brassiere 10, the pouch padding 90 can be located in other areas of the brassiere 10 so as to maintain the shape and fit of the cup, or cups, of the brassiere. Pouch padding 90 may contain any material or combination of materials that assist in maintaining the shape of the brassiere, such as natural fibers, synthetic fibers, foam, or other types of plush materials, including any combinations, subcombinations, or blends thereof.

Figure 3A:
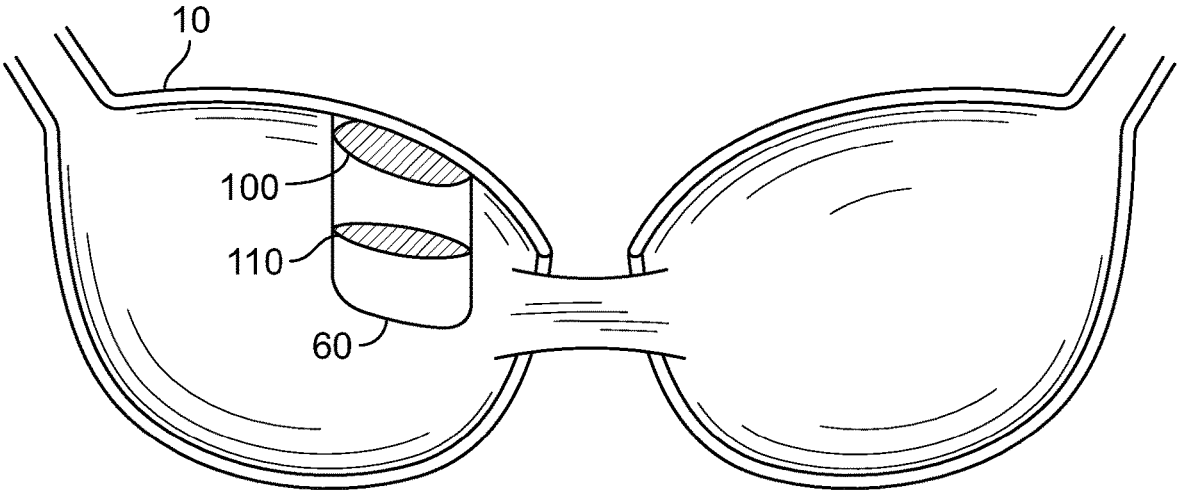
FIGS. 3A and 3B are drawings of the inside view of example brassieres.
Figure 3B:
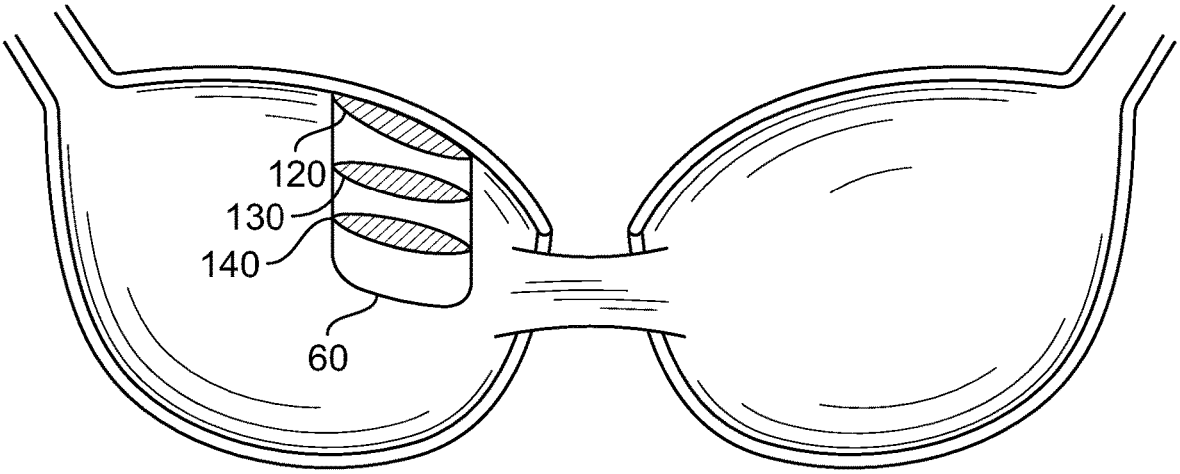

FIGS. 3A and 3B show examples of removable pouches that can be optionally attached to the inside of the brassiere 10. In some implementations, as shown in FIGS. 3A and 3B, the removable pouch contains two or more pockets, where each of the pockets has a bottom edge, a top edge, and a pair of side edges. Depending on the shape of the removable pouch, these edges may be straight, curved, rounded, or otherwise shaped differently than the implementation shown in FIGS. 3A and 3B based on the style and size of the brassiere.

Referring to FIG. 3A, the removable pouch 60 can have two, overlapping pockets (100, 110). Referring to FIG. 3B, the removable pouch 60 can have three, overlapping pockets (120, 130, 140). Alternatively, the removable pouch may have more than three pockets. In some implementations, one or more of the pockets in the removable pouch need not overlap with one or more of the other pockets. Each of the pockets of the removable pouch 60 can be large enough to hold a credit card. In other implementations, at least one of the pockets of the removable pouch can be large enough to hold a credit card.

Figure 4A:
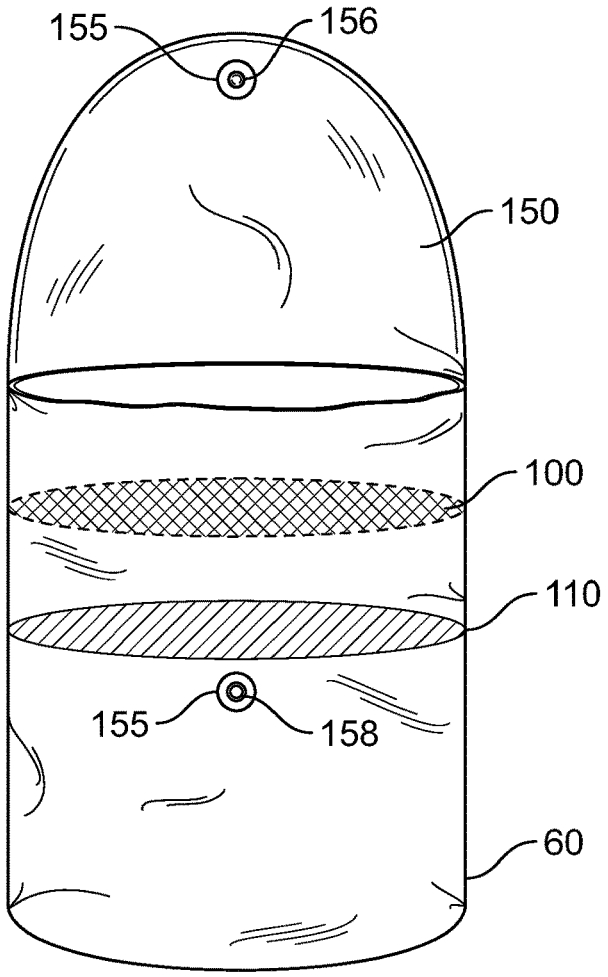
FIGS. 4A, 4B, 5A, and 5B are drawings of example removable pouches from the inside view of example brassieres.
Figure 4B:
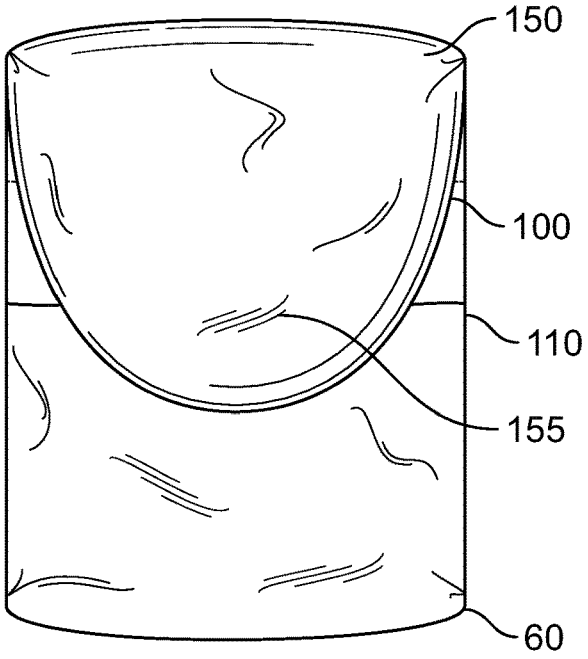

Referring to FIGS. 4A and 4B, the removable pouch 60 may possess a pouch flap 150 that extends from the top edge of the removable pouch 60 and folds over the top edges of pockets 100 and 110. Referring specifically to FIG. 4B, the pouch flap 150 can be inserted into pocket 110. Alternatively, the pouch flap 150 can extend over only one pocket and can be inserted into pocket 100. The pouch flap 150 need not completely cover the opening of one or more of the pockets in the removable pouch 60.

Although FIGS. 4A and 4B refer to a pouch flap 150, the receiving area flap 80 (FIGS. 1A and 2) can also be used to cover the pockets of the removable pouch 60 when the removable pouch 60 is attached to the brassiere 10. The receiving area flap 80 may therefore serve the dual function of covering the fastener 50 of the brassiere (FIG. 1A) when the removable pouch 60 is not attached, and of covering the pockets 100 and 110 (FIG. 4A) of the removable pouch 60 when the removable pouch 60 is attached. The receiving area flap 80 can be inserted into pocket 100 or pocket 110 of FIGS. 4A and 4B. Alternatively, the receiving area flap 80 can extend over only one pocket and can be inserted into pocket 100. The receiving area flap 80 need not completely cover the opening of one or more pockets in the removable pouch 60 that is attached to the brassiere.

In some implementations, the removable pouch may contain three or more pockets, and the pouch flap 150 or the receiving area flap 80 may cover one or more of the pockets and may be inserted into one or more of the pockets. The pouch flap or the receiving area flap can be used to secure the contents carried in the removable pouch or to obstruct the view of the carried contents. In some implementations, the brassiere can have both a receiving area flap attached to the brassiere and a pouch flap attached to the removable pouch.

The pouch flap 150 (FIGS. 4A, 4B) or receiving area flap 80 (FIGS. 1A, 2) may further include a fastening assembly to secure the pouch flap 150 or the receiving area flap 80 to the removable pouch 60. The fastening assembly may be made of a snap button, a button and a hole, hook and loop fastener, hooks, adhesive, magnets, or other resealable fasteners used to attach and detach cloth pieces. The fastening assembly may be configured so as not to irritate the skin. Referring to FIG. 2, the receiving area flap 80 and removable pouch 60 may be secured to each other using a fastening assembly 85. Referring to FIGS. 4A and 4B, the pouch flap 150 and removable pouch 60 may be secured to each other using a fastening assembly 155. The fastening assembly 155 may be made of a snap stud 156 configured to fit into a snap socket 158, where the former is attached to the pouch flap 150 and the latter is attached to the removable pouch 60. Alternatively, the inside of the pouch flap 150 may contain a snap socket configured to fit into a snap stud that is attached to the removable pouch 60.

Figure 5A:
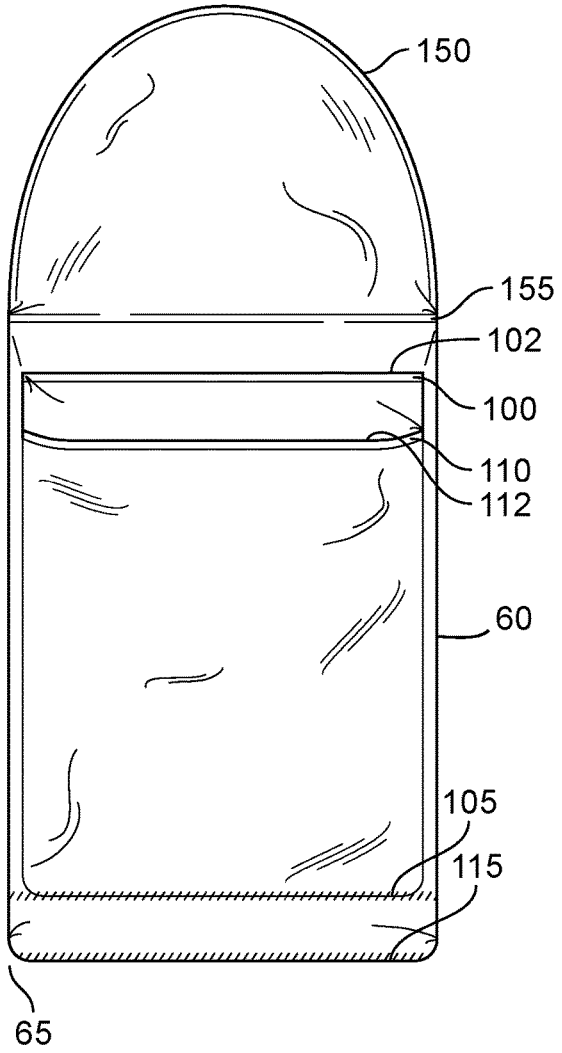
Figure 5B:
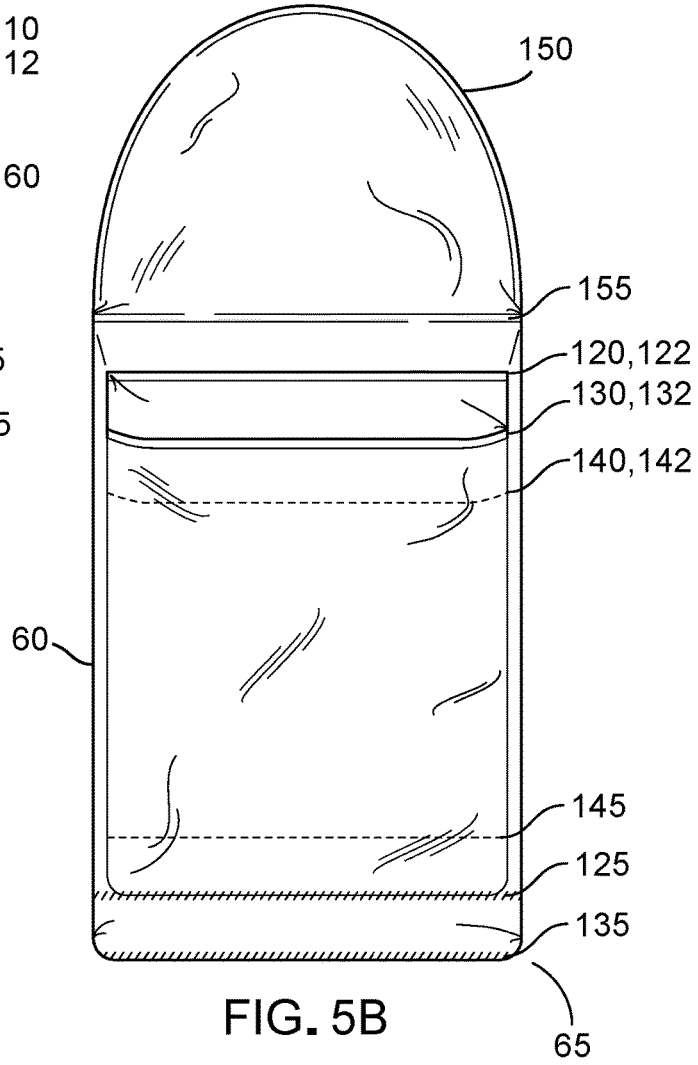

FIGS. 5A and 5B illustrate examples of particular implementations of the removable pouch 60. Referring to FIG. 5A, the removable pouch 60 may contain a first pocket 100 and a second pocket 110. Each of the pockets 100 and 110 may contain a corresponding top edge (102, 112) and bottom edge (105, 115), respectively. The top edges 102 and 112 may be located beneath the fold 155 of the pouch flap 150. The first pocket 100 and second pocket 110 may overlap with each other, so as to increase the layers of material between contents carried in the first pocket 100 and the skin, as compared to contents carried in the second pocket 110 and the skin. Other implementations can vary the amount of overlap between the multiple pockets in the removable pouch 60, including making the pockets entirely coextensive.

Referring to FIG. 5A, the bottom edge 105 of first pocket 100 need not be coextensive with the bottom edge 65 of the removable pouch 60. Alternatively, any one of the pockets of the removable pouch can have bottom edges that are not coextensive with the bottom edge 65 of the removable pouch 60. In some implementations, the top edge of 102 of pocket 100 may be located on the fold 155 of the pouch flap 150, as opposed to beneath it.

FIG. 5B illustrates an example of a removable pouch 60 having three pockets 120, 130, and 140. As FIG. 5B shows, each of the pockets (120, 130, 140) can contain a corresponding top edge (122, 132, 142) and bottom edge (125, 135, 145), respectively. The top edge 122 of first pocket 120 can be located beneath the fold 155 of the pouch flap 150. The top edge (132, 142) of the second and third pockets (130, 140) can be staggered beneath the top edge 122 of the first pocket 120.

Referring to FIG. 5B, the third pocket 140 can be similar in width but smaller in length than the first pocket and second pockets (120, 130). The bottom edge of the third pocket 145, for example, may be located above the bottom edge 125 of the first pocket 120 which, in turn, may be located above the bottom edge 135 of the second pocket 130 which, in turn, may be coextensive with the bottom edge 65 of the removable pouch. The first pocket 120, second pocket 130, and third pocket 140 may overlap with each other, so as to increase the layers of material between contents carried in the first pocket 120 and the skin, as compared to contents carried in the second pocket 130 and the skin, and as compared to the contents carried in the third pocket 140 and the skin. Other implementations can vary the amount of overlap between the multiple pockets in the removable pouch 60, including making the pockets entirely coextensive. Some implementations may also vary the location of the top edges 122, 132, and 142 of the pockets in relation to the fold 155 of the pouch flap 150.

In a particular implementation of a two-pocket removable pouch shown in FIG. 5A, pocket 100 can be approximately 3¾ inches long and pocket 110 can be approximately 3¼ inches long. The pouch flap 150 can be approximately 1¾ inches long, and the width of pouch flap 150, pocket 100, and pocket 110 can be approximately 2⅛ inches wide. Of course, other appropriate dimensions can be used.

In a particular implementation of a three-pocket removable pouch shown in FIG. 5B, pocket 120 can be approximately 3¾ inches long, pocket 130 can be approximately 3¼ inches long, and pocket 140 can be approximately 2 in. long. The pouch flap 150 can be approximately 1¾ inches long, and the width of the pouch flap 150, pocket 120, pocket 130, and pocket 140 can be approximately 2⅛ inches wide. Of course, other appropriate dimensions can be used.

In both of the two- and three-pocket removable pouches shown in FIGS. 5A and 5B, the removable pouch can contain a trim along the side edges and bottom edge. In a particular implementation, for example, the removable pouch containing a trim may be approximately 3 inches wide. The pouch flap 150, or the receiving area flap 80, may also contain a trim along the edges of the flaps, respectively, that matches the trim of the removable pouch.

In some implementations, the pouch flap 150 as depicted in FIGS. 5A and 5B can be replaced with the receiving area flap 80, where the receiving area flap 80 may be used to cover one or more pockets of the removable pouch 60 and may be affixed to the removable pouch 60 by using fastening assembly. For example, the receiving area flap 80 can be approximately 1¾ inches long (or another appropriate length) and can contain a trim that matches the trim of a removable pouch.

One or more of the pockets within the removable pouch 60 can optionally have a waterproof inner lining for keeping contents dry in wet environments or for resisting exposure of carried contents to moisture that may damage the contents. The waterproof inner lining is in some implementations made of plastic, but can also be made of other waterproof, water resistant, or sweat resistant materials. Suitable materials for the waterproof inner lining include pleather, vinyl, rubber, polyurethane laminate, thermoplastic polyurethane, polyvinyl chloride (PVC)-coated polyester, terylene, laminated cotton or poplin, oilcloth, coated fabrics, or any combinations, subcombinations, or blends thereof. In some implementations, the waterproof inner lining may be removable and optionally inserted inside one or more of the pockets in the removable pouch. Alternatively, the waterproof lining can be attached to one or more pockets of the removable pouch.

Figure 6:
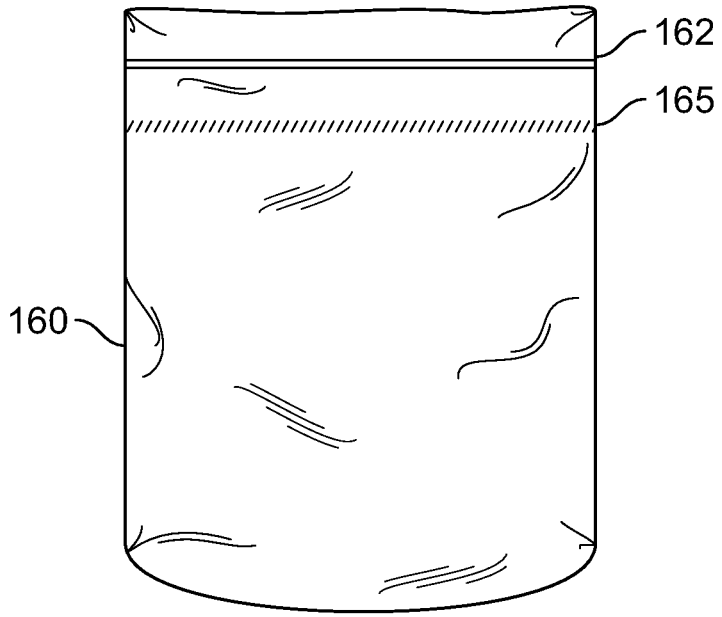
FIG. 6 is a drawing of an example waterproof inner lining that can be placed inside a pocket of a removable pouch of an example brassiere.

The waterproof inner lining may contain one or more seals affixed to the inside wall of the waterproof inner lining. FIG. 6 illustrates an example waterproof inner lining 160 that has an inside wall, an outside wall, a bottom edge, a top edge, and a pair of side edges. The waterproof inner lining, which may be rectangular in shape as depicted in FIG. 6, can have a first seal 162 and a second seal 165 that run perpendicular to, or otherwise extend between, the side edges of the waterproof inner lining 160. Referring to FIG. 6, the first seal 162 may be located closer to the top edge of the waterproof inner lining than the second seal 165.

One or more seals of the waterproof inner lining may be formed from an interlocking groove and ridge that form a tight seal when pressed together (referred to as a zipper bag seal), releasably sealable materials (e.g., plastic resin materials), spray adhesives, magnetic strips, and any combinations or subcombinations thereof. Referring to FIG. 6, the first seal 162 can be a zipper bag seal and the second seal 165 can be formed from a plastic resin material that grippingly engages a second side formed from the plastic resin material when pressed together. Alternatively, the first seal 162 can be formed from the plastic resin material and the second seal 165 can be a zipper bag seal. The plastic resin material of the second seal 165 can be a pressure sensitive adhesive that is releasably sealable and made of microscopic spikes that keep the adhesive away from the target surface until deliberately crushed by pressing. Suitable plastic resin material may include those available from the Glad Products Company under the trade name GLAD® PRESS'N SEAL®.

Figure 7:
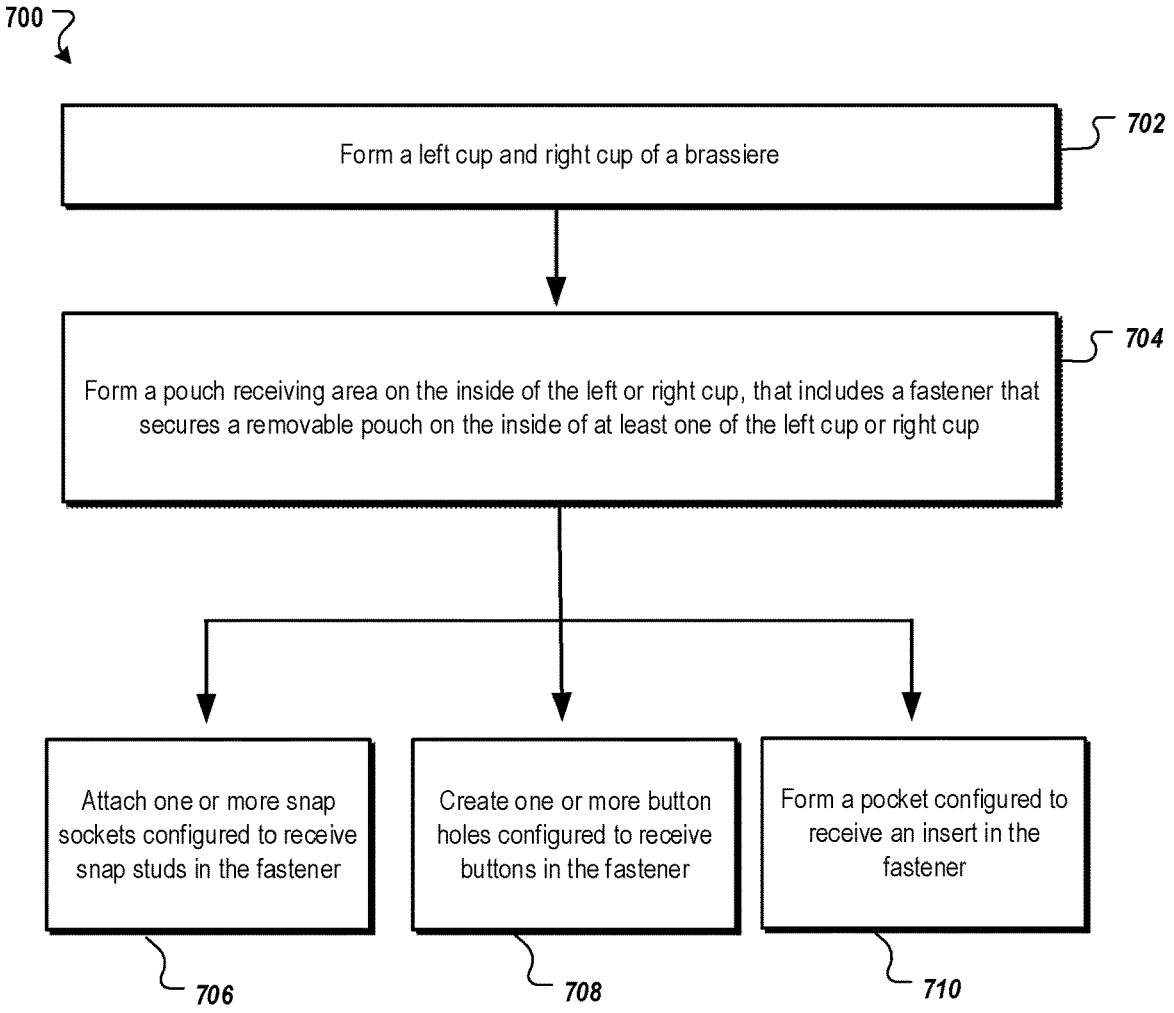
FIG. 7 is a flow-chart of a method of forming an example brassiere.

FIG. 7 illustrates a method 700 of forming a brassiere that includes a left cup and right cup, and a fastener for securing a removable pouch on the inside of left cup or right cup. A left cup and right cup of the brassiere are formed (702). The left cup may be formed first, the right cup may be formed first, or both cups may be formed simultaneously. Each of the cups can be formed from fabric or another appropriate material. Each of the cups can be formed to include padding.

A pouch receiving area is formed on the inside of the left or right cup (704). The pouch receiving area may include a fastener that secures a removable pouch on the inside of the left or right cup, as discussed above. The fastener, as previously described, may be one or more snap sockets configured to receive snap studs, snap studs configured to receive snap sockets, button holes configured to receive buttons, buttons configured to receive button holes, hook-type fasteners, loop-type fasteners, parts of a zipper, or other fasteners typically used in apparel for attaching or detaching cloth pieces. FIG. 7 illustrates several options for implementing the fastener. For example, the fastener can be implemented by attaching one or more snap sockets configured to receive snap studs (706). Alternatively, the fastener may be implemented by creating one or more button holes configured to receive buttons (708). In some situations, the fastener can be implemented by forming a pocket configured to receive an insert (210). In some implementation methods, a second pouch receiving area may also be formed on the inside of the left cup or right cup of the brassiere, forming two pouch receiving areas in the brassiere, one in each respective cup.

Referring to FIGS. 1A, 1B, 3A, and 3B, the brassieres may permit the carrying of personal items on a daily basis and give a person the option to attach the removable pouch when desired while performing certain tasks in different environments. For example, a wearer may detach the removable pouch when desired without removing the brassiere, such as when wearing an evening gown, when taking photographs, or when the carrying of personal items becomes unnecessary. As another example, the brassieres may permit the detachment of the removable pouch from the brassiere for cleaning. Referring to FIGS. 1A, 1B, 3A, and 3B, the brassieres may allow a person to more easily retrieve items by placing the removable pouch 60 closer to the center of the brassiere. Such placement, for example, avoids jostling of the removable pouch 60 from shoulder movement. The brassieres described here can be used by persons of all ages, genders, and orientations that use brassieres, including minors and adults.

Referring to FIGS. 3A, 3B, 4A, 4B, 5A, and 5B, a person can more efficiently optimize the space available in a brassiere to carry multiple personal items. For example, as shown in FIGS. 5A and 5B, the use of multiple, layered pockets that are not coextensive in length with the removable pouch permits the carrying of multiple items while enabling easier retrieval of items at the bottom of a pocket. Suitable personal items for carrying in the brassieres include but are not limited to personal identification, credit cards, cash, coins, jewelry, keys, ear phones, ear pods, makeup, lip balms, etc. The brassieres may also secure personal items in the brassiere based on the friction that is created between the removable pouch and the skin. For example, the brassiere may avoid the loss of personal items even when a wearer is subjected to sudden force or movement, such as when participating in sports or recreational activities, or visiting amusement and water parks.

Referring to FIG. 6, some implementations of the brassieres may also protect personal items from water, moisture, or sweat. For example, the brassieres may permit a wearer carrying personal items to engage in activities, such as swimming, going to water parks, and hiking outdoors, without exposing the personal items to water or moisture.

Other implementations are contemplated. For example, referring to FIGS. 1A, 1B, 2, 3A, and 3B, the brassiere may be modified to accommodate brassieres of all available sizes. The pouch receiving area, removable pouch, and fastener may be modified to accommodate the different brassiere sizes, including alterations in cup size and the length and width of the brassiere. The brassieres may have straps or be strapless, and may be wired or wireless. Referring to FIGS. 4A, 4B, 5A and 5B, the pockets and removable pouch may also be modified to accommodate different brassiere sizes and styles as well as differently sized items. The brassiere may be made from materials such as natural fibers, synthetic fibers, and one or more combinations, subcombinations, and blends thereof. The brassieres may be made of a variety of patterns and colors, including patterns or colors that aesthetically reduce the appearance of the removable pouch when attached to the brassiere. The materials used to make the brassiere can be machine-washable. The brassiere may also be adapted for use in swimwear, athletic wear, lounge wear, or personal protective equipment. Some implementations may also include brassieres intended to be lightweight and to hold multiple items without creating undue weight on the chest.

While this specification contains many specific implementation details, these should not be construed as limitations on the scope of any features or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Thus, particular embodiments of the subject matter have been described. The invention in its broader aspects is not limited to the specific details and exemplary embodiments, shown and described herein. Other embodiments are within the scope of the following claims. In some cases, the actions recited in the claims can be performed in a different order and still achieve desirable results.

What is claimed is:

1. A brassiere, comprising:

a left cup;

a right cup;

a pouch receiving area formed on an inside of the left cup or the right cup, wherein the pouch receiving area includes a fastener that secures a removable pouch on an inside of at least one of the left cup or the right cup; and wherein the removable pouch has a perimeter defined by a top edge, bottom edge, and a pair of side edges; at least two pockets are formed within the perimeter of the removable pouch; and wherein each of said pockets has a bottom edge, a top edge, and pair of side edges.

2. The brassiere of claim 1, wherein the fastener comprises at least one snap socket configured to receive a snap stud.

3. The brassiere of claim 1, wherein the fastener comprises at least one button hole configured to receive a button.

4. The brassiere of claim 1, further comprising a receiving area flap that covers the fastener when the removable pouch is not located in the pouch receiving area.

5. The brassiere of claim 4, wherein said receiving area flap further comprises a fastening assembly to secure said receiving area flap to a removable pouch.

6. The brassiere of claim 1, wherein said left cup or said right cup comprises pouch padding that reduces an outward visual appearance of the removable pouch when located in the pouch receiving area.

7. The brassier of claim 1, wherein at least one of the at least two pockets is configured to hold a credit card.

8. The brassier of claim 1, wherein the removable pouch comprises a snap stud for securing said removable pouch to the pouch receiving area.

9. The brassiere according to claim 1, wherein the bottom edge of said removable pouch is not coextensive with the bottom edge of at least one of the at least two pockets.

10. A brassiere, comprising:

a left cup;

a right cup;

a pouch receiving area formed on an inside of the left cup or the right cup, wherein the pouch receiving area includes a fastener that secures a removable pouch on an inside of at least one of the left cup or the right cup; and wherein the removable pouch comprises a top edge, bottom edge, a pair of side edges, and at least two pockets, wherein each of said pockets has a bottom edge, a top edge, and a pair of side edges, wherein the removable pouch comprises a pouch flap extending from the top edge of said removable pouch for folding over a top edge of at least one pocket.

11. The brassier of claim 10, wherein said pouch flap further comprises a fastening assembly to secure said pouch flap to said removable pouch.

12. A brassiere, comprising:

a left cup;

a right cup;

a pouch receiving area formed on an inside of the left cup or the right cup, wherein the pouch receiving area includes a fastener that secures a removable pouch on an inside of at least one of the left cup or the right cup; and wherein the removable pouch comprises a top edge, bottom edge, a pair of side edges, and at least two pockets, wherein each of said pockets has a bottom edge, a top edge, and a pair of side edges, wherein at least one of said pockets comprises:

a waterproof inner lining having an inside wall, an outside wall, a bottom edge, a top edge, and pair of side edges; and wherein said waterproof inner lining comprises at least one seal affixed to said inside wall running perpendicular to said side edges.

13. The brassiere of claim 12, wherein the waterproof inner lining further comprises a second seal affixed to said inside wall extending between said side edges.

14. The brassiere of claim 12, wherein at least one seal comprises a first side formed from a plastic resin material that grippingly engages a second side formed from the plastic resin material when pressed together.

15. The brassiere of claim 13, wherein at least one seal is located more proximate to the top edge of the waterproof inner lining than at least another seal that is located at a given distance between the top edge and the bottom edge of said waterproof inner lining.

16. The brassiere of claim 12, wherein the waterproof inner lining is removable.

* * * * *